United States Patent [19]

Arthur

[11] Patent Number: 4,511,420

[45] Date of Patent: Apr. 16, 1985

[54] CONTINUOUS ROD MANUFACTURE

[75] Inventor: Hugh M. Arthur, Bucks, England

[73] Assignee: Molins, Ltd., London, England

[21] Appl. No.: 328,716

[22] Filed: Dec. 8, 1981

[30] Foreign Application Priority Data

Dec. 16, 1980 [GB] United Kingdom ..... 8040239

[51] Int. Cl.[3] ..... A24D 3/02

[52] U.S. Cl. ..... 156/356; 156/360; 156/441; 156/461; 156/578; 493/49; 493/4; 131/906; 131/84 R

[58] Field of Search ..... 131/910, 84 R, 280, 131/84 A, 84 B, 84 C, 906, 909; 493/4, 49, 44; 156/461, 180, 201, 203, 441, 360, 356, 578, 351, 64; 73/37.7, 38

[56] References Cited

U.S. PATENT DOCUMENTS

| | | | |
|---|---|---|---|
| 3,399,606 | 9/1968 | Molins | 493/4 |
| 3,742,232 | 6/1973 | Koehn et al. | 131/280 |
| 3,971,695 | 7/1976 | Block | 156/461 |
| 3,974,007 | 8/1976 | Greve | 156/64 |
| 3,986,517 | 10/1976 | Broscheit | 131/909 |
| 4,038,531 | 7/1977 | Loe, Jr. | 156/360 |
| 4,283,998 | 8/1981 | Greve et al. | 493/4 |

FOREIGN PATENT DOCUMENTS

| | | | |
|---|---|---|---|
| 2120557 | 11/1972 | Fed. Rep. of Germany | 493/49 |
| 2066707 | 7/1981 | United Kingdom | 131/280 |

*Primary Examiner*—V. Millin
*Assistant Examiner*—Harry Macey
*Attorney, Agent, or Firm*—Antonelli, Terry & Wands

[57] ABSTRACT

Production of cigarette filter rod is controlled by monitoring the tow (12) or rod (18) to provide signals indicative of tow consumption rate and varying the composition of the rod in accordance with the signals, e.g. to maintain a constant proportion by weight in the rod of tow and a plasticizer applied to the tow by an applicator device (18). The tow feed rate or the plasticizer supply rate may be varied in accordance with the signals. The monitoring device may comprise a tow bale weight sensor (48), a rod scanning head (54), or a weight band (33,57).

27 Claims, 3 Drawing Figures

CONTINUOUS ROD MANUFACTURE

This invention is concerned with apparatus for making continuous rod of the tobacco industry, particularly for the production of cigarette filters.

One aspect of the present invention provides apparatus for making continuous rod of the tobacco industry, comprising means for feeding the major constituent of the rod towards a garniture for forming the rod, means for feeding a secondary constituent of the rod, means for producing signals indicative of the consumption rate of at least the major constituent, and means for varying the relative feed rates of the major and secondary constituents in response to the signals. Preferably the varying means is arranged to maintain a predetermined rod composition. The varying means may be arranged to maintain a constant proportion by weight of secondary to major constituent.

The means for producing signals may include means for monitoring the rate of withdrawal of the major constituent from a source and/or means for monitoring the rod. Preferably said signals are mass or weight signals.

The varying means may be arranged to vary the feed rate of the first and/or the second constituent.

In a preferred arrangement the major constituent is a continuous tow of filter material and the secondary constituent is a fluid additive, e.g. plasticiser. For convenience only the invention is hereinafter described with reference to these preferred constituents. Note, however, that other major constituents, e.g. tobacco or chopped filter tow, and other secondary constituents, e.g. powdered or granular additives, are possible.

The monitoring means preferably monitors the consumption of tow by weight, preferably at a source, e.g. a tow bale from which the tow is withdrawn. Thus, the monitoring means may comprise a weigh cell or the like on which a tow bale is supported while supplying tow. The monitoring means may be arranged to provide signals at intervals, which may be determined by the production of filter rods. For example, where the apparatus is provided with a continuous rod cut-off for producing individual rod lengths, a counter may be associated with the cut-off and linked to the monitoring means to initiate a signal to said varying means after production of each predetermined number of rods. Thus the reduction in weight of the bale for, say, every 10,000 rods (equivalent to about 2 minutes at typical production speeds) can be measured by the monitoring means, compared with a desired value, and a correction signal applied to the varying means.

In a further preferred arrangement filter tow is drawn past an applicator device by which plasticiser is applied to the tow, and means are provided for monitoring the rate of consumption of tow, preferably by weight, and for controlling the rate of application of plasticiser in response to signals derived from the monitoring means. The rate of consumption of tow is preferably monitored by means including a device for measuring tow feed upstream of a plasticiser applicator device, e.g. a tow bale weighing device. However the rate of tow consumption could be measured by means for determining density or mass of the moving tow or filter rod, e.g. a scanning head which effectively detects attenuation (or perhaps scattering) of radiation by the tow or rod. Alternatively, means, such as a weigh band, could be provided for weighing finished filter rods.

The apparatus may include means for monitoring the rate of application of plasticiser, by weight or otherwise. This may be achieved according to the method and apparatus disclosed in British patent specification No. 2066707, to which reference is directed in its entirety.

The ratio of plasticiser to tow or to filter rod may be maintained constant by varying the rate of delivery of plasticiser to the applicator device. Where the rate of delivery of plasticiser is automatically varied in dependence on the speed of the tow or filter rod the varying means may alter the relationship between the delivery rate and said speed.

Monitoring the tow consumption by weight can be particularly useful when the weight of tow in unit rod length does not remain constant. In particular, it may be used to control application of plasticiser when the apparatus includes means for monitoring pressure drop in the tow while feeding it, and means for controlling the feeding of the tow to maintain the pressure drop substantially constant.

In a further preferred form apparatus for producing filter rod comprises means for feeding filter tow towards a rod-forming unit, means for conveying filter tow through said unit, means for applying plasticiser to the tow while feeding it, means for monitoring the rate of consumption of tow, and means for varying one or both of said feeding rate and said application rate relative to said conveying rate. Preferably a prime-mover for driving said conveying means is connected to said feeding means and/or said applying means through a variable ratio device, the ratio of which is controlled by signals from said monitoring means. The monitoring means preferably measures tow consumption rate upstream of the applying means and preferably monitors consumption by weight.

The invention will be further described, by way of example only, with reference to the accompanying diagrammatic drawings, in which.

Figure 1:
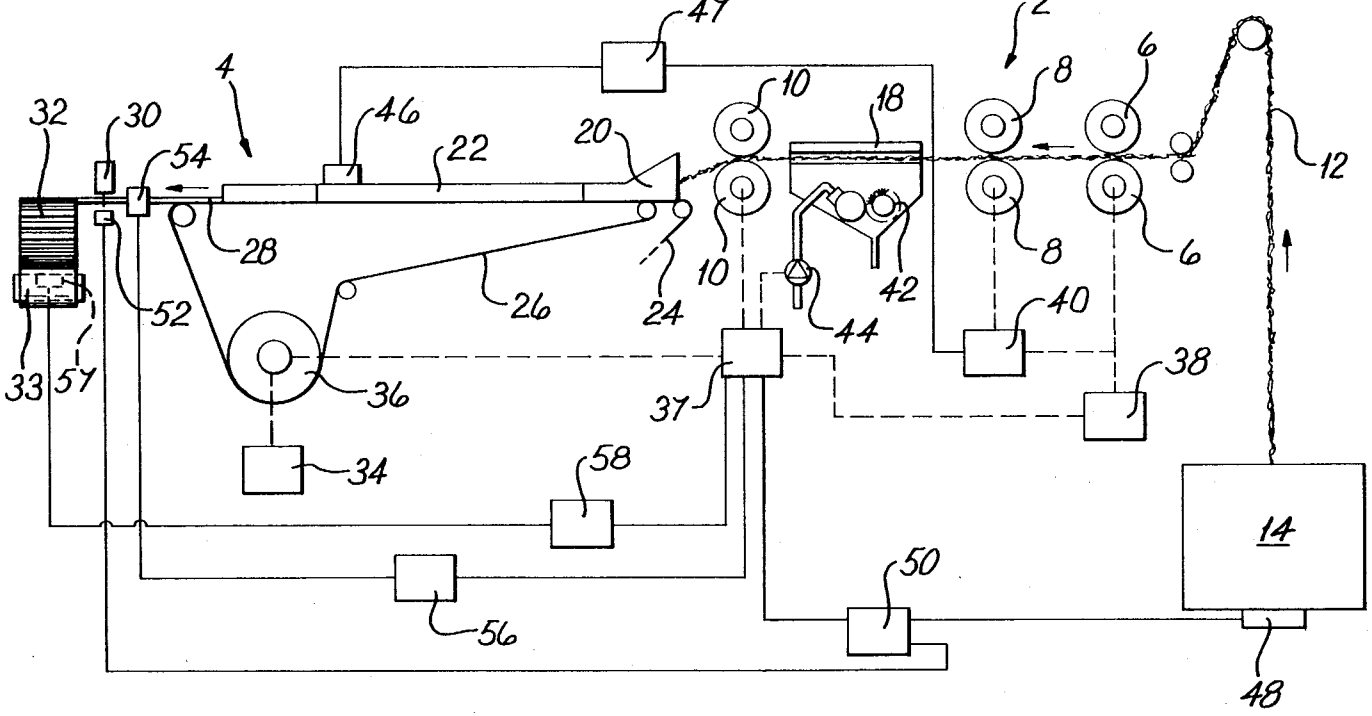
FIG. 1 is a side view of a filter making machine.

Referring to FIG. 1, the filter rod making machine comprises a tow processing unit 2 and a rod making unit 4. The tow processing unit 2 includes three pairs of drive rollers 6, 8 and 10 respectively, which convey a web of tow 12 from a tow bale 14 and through the unit 2. The tow 12 passes through a plasticiser applicator chamber 18 located between the pairs of rollers 8 and 10. From the rollers 10 the tow 12 is gathered in by a converging horn 20 and passes into a garniture 22 of the rod making unit 4 (which may be a Molins PM5N plug maker). In the garniture 22 the tow 12 is compressed and enveloped in a paper wrapper 24 conveyed by a garniture tape 26 so that a sealed filter rod 28 is produced. The rod 28 is cut into separate filter rod lengths by a cut-off 30. These lengths are received and deflected transversely by a deflector drum 32, for collection on a band 33 and/or conveyance to a further processing unit.

The rod forming unit 4 is provided with a motor 34 which drives a pulley 36 for the garniture tape 26. The speed of the rod 28 in the rod-making unit 4 is thus determined by the speed of the motor 34. The pair of rollers 10 nearest the rod-making unit is connected for drive by the motor 34 through a first positively infinitely variable (P.I.V.) gearbox 37. The ratio of the speed of the rod 28 to that of the tow 12 at the rollers 10 is thus determined by the gearbox 37. The upstream pair of rollers 6 is connected for drive from an output of the gearbox 37 which passes through a second P.I.V. gearbox 38. The ratio of the speed of the tow at the rollers 6 to that of the tow at the rollers 10 is therefore determined by the gearbox 38. A third P.I.V. gearbox 40 is connected between an output from the gearbox 38 and the rollers 8 so that the ratio of speed of the tow at the rollers 8 to that at the rollers 6 is determined by the gearbox 40.

Plasticiser, such as triacetin, is applied to the tow 12 in the chamber 18 by a rotary spray brush 42 to which plasticiser is applied by means of a metering pump 44 driven by an output of the gearbox 37. The rate of supply of plasticiser to the chamber 18 therefore varies with the speed of the tow 12 at the adjacent rollers 10.

The ratio of the gearbox 38 is set for a particular operating condition (e.g. tow type) and is not normally varied unless this condition changes. Similarly, mean values of the ratios of gearboxes 37 and 40 may be set according to operating conditions, but the ratios of these gearboxes are also variable in response to signals derived from detectors associated with the machine.

Varying the ratio of the gearbox 37 varies the ratio of the speed of the tow leaving the tow unit 2 to that in the rod unit 4; this varies the amount of tow 12 per unit length of rod 28 produced. Varying the ratio of the gearbox 40, which is set so that the rollers 8 rotate more quickly than the rollers 6 and so stretch the tow 12, alters the amount by which the crimp is removed from the tow (and can also affect the quantity of tow in the filter rod).

A first detector 46 comprises a device for detecting the pressure drop in the tow 12 or rod 28. The detector 46 is preferably as disclosed in British patent specification No. 1588506 and located at the downstream end of the garniture 22. However, other devices capable of detecting variations in air pressure drop in the tow before it is finally sealed into a rod, e.g. as disclosed in British patent specification No. 1128685, or for detecting pressure drop in the rod 28 (possibly after cutting) could be used. Signals from the detector 46, which are indicative of the pressure drop in filters formed from the tow 12 and rod 28, are applied to the gearbox 40 via a control unit 47. The ratio of the gearbox 40 may therefore be controlled in accordance with signals derived from the detector 46 (as processed by the unit 47) to control the stretching of the tow 12 between the rollers 6 and 8.

A detector 48 comprising a tow bale weighing device is connected to the gearbox 37 through a control unit 50. The detector 48 provides continuous weight measurements of the tow bale 14. The control unit 50 includes a circuit which responds to a rod count sensor 52 located adjacent to the cut-off 30 so that signals applied to the gearbox 37 may be representative of tow weight consumption, i.e. in terms of weight of tow consumed for a predetermined number of rods produced.

A further detector 54 is located adjacent to the cut-off 30 and comprises a radiation detector for continuously measuring rod mass or density by attenuation of radiation passing through the rod. The detector may be associated with a beta radiation source such as employed in Molins MODIC or MAID. A control unit 56 is provided to process the signals from the detector 54 and to produce an output signal for varying the ratio of the gearbox 37, if necessary.

Yet another detector, comprising a weight sensor 57 associated with the band 33 for weighing a predetermined number of rods and for supplying a weight signal to a further control unit 58, provides a further signal capable of varying the ratio of gearbox 37.

The detectors 54, 48, and 57 (and associated control units) may be used in combination (as shown) or separately or in any other combination.

Each of the control units 47, 50, 56, and 58 may include means for introducing a reference or desired value of the measured characteristic, means for comparing the actually measured value with the desired value, and means for producing an appropriate correction signal for application to the respective gearbox.

Figure 2:
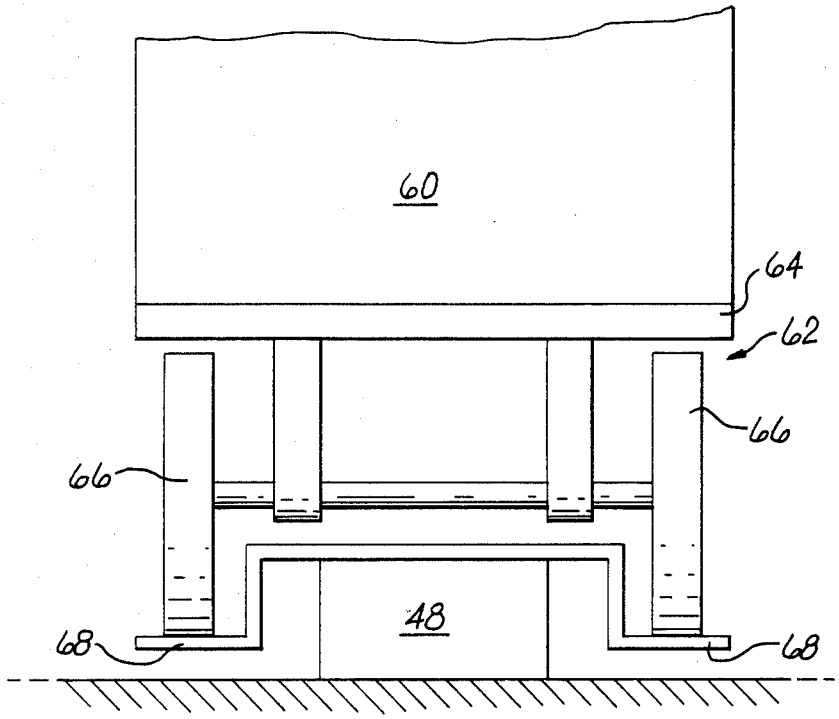
FIG. 2 is a section taken on line II—II of FIG. 3.
Figure 3:
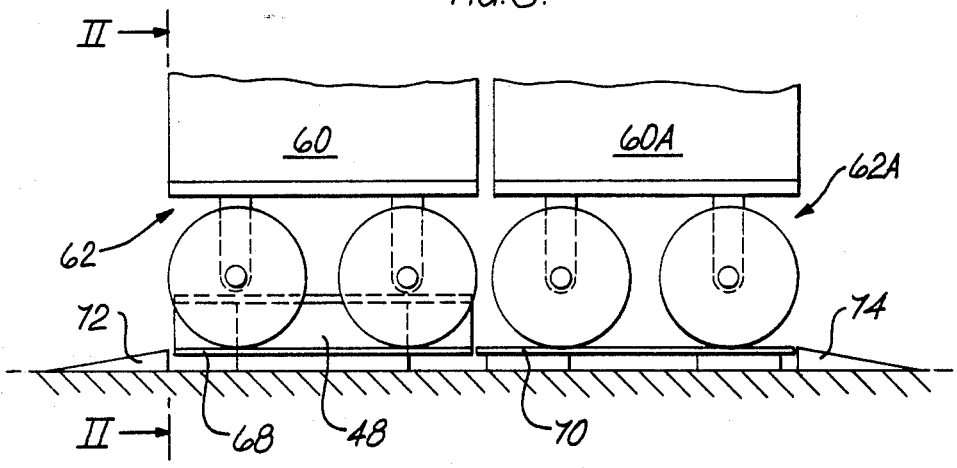
FIG. 3 is a side view of the device of FIG. 2.

FIGS. 2 and 3 show how the weighing device comprising the detector 48 may be constructed. A tow bale 60 is supported on a trolley 62, which includes a platform 64 and wheels 66. The detector 48 comprises a load cell which carries tracks 68 raised sufficiently far off the floor to allow the required movement of the load cell. A stationary track 70 is positioned adjacent and in alignment with the movable track portion 68, and a replacement bale 60A and trolley 62A are positioned in readiness for transfer to the operative position when required. Ramps 72 and 74 are provided for movement of the trolleys to and from the slightly elevated tracks 68 and 70; alternatively, the ramp 74 may be omitted and the track 70 may be lifted to the level of the tracks 68 by hydraulic jacks after a full trolley has been pushed onto it.

The arrangement shown in FIGS. 2 and 3 allows the load cell to be accommodated between the wheels of the trolley. If an even higher load cell is needed, the wheels on opposite sides of the trolley may be mounted on separate stub shafts thus allowing room for a load cell of a height nearly equal to the diameter of the wheels without further raising the tracks 68.

I claim:

1. Apparatus for making continuous rod of the tobacco industry, comprising a garniture for forming the rod, means for supplying a major constituent of the rod along a path to the garniture including feeding means for feeding at least said major constituent of the rod on said path towards the garniture at a controlled feed rate, means for feeding a secondary constituent of the rod towards said major constituent at a position upstream of said feeding means, means for producing signals indicative of the consumption rate of at least the major constituent, said signal producing means including a detector for detecting the consumption rate of said major constituent upstream of said position; and means for varying the relative feed rates of the major and secondary constituents in response to the signals produced by said signal producing means, including means for changing the feed rate of said feeding means for the major constituent.

2. Apparatus as claimed in claim 1, wherein the varying means comprises means for maintaining a predetermined rod composition.

3. Apparatus as claimed in claim 1, wherein said varying means comprises means for maintaining said composition of said rod at a constant proportion by weight of secondary to major constituent.

4. Apparatus as claimed in claim 1, wherein the means for producing signals includes means for monitoring the rate of withdrawal of the major constituent from a source.

5. Apparatus as claimed in claim 2, wherein the means for producing signals includes means for monitoring the rod.

6. Apparatus as claimed in claim 4 or claim 5, wherein said means for producing signals comprises means for producing signals indicative of the weight of the major constituent.

7. Apparatus as claimed in claim 1, wherein the varying means comprises means for varying the feed rate of the secondary constituent.

8. Apparatus as claimed in claim 7, further including means for monitoring the feed rate of the secondary constituent.

9. Apparatus as claimed in claim 1 or claim 8, wherein the secondary constituent is a fluid additive.

10. Apparatus as claimed in claim 1, including means for monitoring pressure drop in the rod, and means for changing the feed rate of the major constituent to maintain said pressure drop in a predetermined range.

11. Apparatus as claimed in claim 1, wherein the major constituent is a tow of filter material, including further feeding means for the major constituent located upstream of said position and having means for feeding said constituent at different speeds at different locations, said varying means including means for varying the ratio of said speeds.

12. Apparatus as claimed in claim 1, wherein the major constituent is a tow of filter material, said means for feeding a secondary constituent of the rod comprises an applicator device adjacent the path of the filter tow for applying fluid additive to the tow, and said means for varying the relative feed rates of the major and secondary constituents includes means for controlling the rate of application of fluid additive by said applicator device in response to the signals from said signal producing means.

13. Apparatus as claimed in claim 12, further including means for monitoring the tow or rod to determine a rod characteristic, means for controlling said conveying means to vary the tow consumption rate to maintain said characteristic substantially constant, said controlling means for applying fluid additive being arranged to maintain a substantially constant proportion of fluid additive to tow in said row.

14. Apparatus as claimed in claim 1, further including means for changing the feed rate of the feeding means for the secondary constituent in response to said signals.

15. Apparatus as claimed in claim 14, including means for measuring the feed rate of the feeding means for the secondary constituent, and means for changing the feed rate of the feeding means for the secondary constituent in response to signals derived from said measuring means.

16. Apparatus as claimed in claim 15, wherein the measuring means includes means providing signals indicative of the weight of the secondary constituent.

17. Apparatus for making continuous filter rod, comprising means for conveying a filter tow on a path, means including an applicator device arranged adjacent said path for applying fluid additive to the tow on said path, means for monitoring the rate of consumption of tow at a position upstream of said applicator device, means for controlling said conveying means downstream of said applicator device in response to signals derived from said monitoring means, and means for controlling the rate of application of fluid additive in response to signals derived from said monitoring means.

18. Apparatus as claimed in claim 17, further including means for monitoring the tow or rod to determine a rod characteristic, means for controlling said conveying means to vary the tow consumption rate to maintain said characteristic substantially constant, said controlling means for applying fluid additive being arranged to maintain a substantially constant proportion of fluid additive to tow in said rod.

19. Apparatus as claimed in claim 17, wherein the monitoring means includes means providing weight signals from a source of tow.

20. Apparatus for making continuous rod of the tobacco industry, comprising a garniture, means for feeding a major constituent of the rod towards the garniture, means for conveying said major constituent of the rod through the garniture, means for applying a secondary constituent of the rod to the major constituent while feeding it, means for monitoring the rate of consumption of the major constituent at a location upstream of said applying means, and means for varying the feed rate of said feeding means and said applying means relative to the rate of said conveying means in response to signals derived from said monitoring means.

21. Apparatus as claimed in claim 20, wherein said major constituent of the rod is filter tow and said secondary constituent of the rod is fluid additive.

22. Apparatus as claimed in claim 21, further including drive means for said conveying means, a variable ratio device connected between said drive means and said feeding means and said applying means, said monitoring means being connected to said device for control thereof.

23. Apparatus for making continuous rod of the tobacco industry, comprising first and second means for feeding a major constituent of the rod towards a garniture for forming the rod, said first feeding means being located upstream of said second feeding means relative to the direction of feed of the major constituent, third means for feeding a secondary constituent of the rod towards the major constituent at a position between said first and second feeding means, means for producing first signals indicative of the consumption rate of at least the major constituent, means for monitoring a pressure drop in the tow or rod and for producing second signals indicative of said pressure drop, means for varying the relative feed rates of the major and secondary constituents in response to the first signals and the second signals, including means for changing the feed rate of said third feeding means in response to said first signals and means for changing the feed rate of said first feeding means in response to said second signals.

24. Apparatus as claimed in claim 23, further including means for changing the feed rate of said second feeding means in response to said first signals.

25. Apparatus as claimed in claim 23, wherein said means for changing the feed rate of said first feeding means in response to said second signals includes means for comparing said signals with a predetermined value and adjusting said feed rate appropriately to reduce the difference between said signals and said predetermined value, so that said rod will have a predetermined pressure drop, and said means for changing the feed rate of said third feeding means is arranged so that the second constituent is fed at a rate proportional to the consumption rate of the major constituent.

26. Apparatus for making continuous rod of the tobacco industry, comprising a garniture for forming the rod, first feeding means for feeding a major constituent of the rod towards the garniture, second feeding means for feeding a secondary constituent of the rod towards said major constituent upstream of said garniture, first signal means for producing signals indicative of the consumption rate of said major constituent, second signal means for producing signals indicative of the consumption rate of said secondary constituent, means for varying the feed rate of the first feeding means in accordance with signals derived from the first signal means, and means for varying the feed rate of the second feeding means in accordance with signals derived from the first signal means and the second signal means.

27. Apparatus as claimed in claim 26, wherein said first signal means includes means for producing a weight signal from said major constituent upstream of said feeding means.

* * * * *